US010975544B1

(12) United States Patent
Clemons

(10) Patent No.: US 10,975,544 B1
(45) Date of Patent: Apr. 13, 2021

(54) WORK TOOL COUPLING ASSEMBLY WITH LOCKING WEDGE

(71) Applicant: Caterpillar Inc., Peoria, IL (US)

(72) Inventor: Kevin Clemons, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/859,224

(22) Filed: Apr. 27, 2020

(51) Int. Cl.
*E02F 3/36* (2006.01)

(52) U.S. Cl.
CPC ..... *E02F 3/3622* (2013.01); *E02F 3/364* (2013.01); *E02F 3/3663* (2013.01)

(58) Field of Classification Search
None
See application file for complete search history.

(56) References Cited

U.S. PATENT DOCUMENTS 4,643,631 A 2/1987 Case
6,241,455 B1 6/2001 Case
7,223,061 B2 5/2007 Gelb
9,051,716 B2 6/2015 Bricker
9,834,904 B2 * 12/2017 Friedrich ..... E02F 3/3618
9,863,117 B2 * 1/2018 Calvert ..... E02F 3/3627
10,156,055 B2 12/2018 Kovar et al.
2015/0322646 A1 * 11/2015 Anderson ..... E02F 3/3627 403/322.1
2017/0121928 A1 5/2017 Robl et al.
2020/0190765 A1 * 6/2020 Clemons ..... E02F 3/364

* cited by examiner

*Primary Examiner* — Gerald McClain
(74) *Attorney, Agent, or Firm* — Procopio, Cory, Hargreaves & Savitch LLP

(57) ABSTRACT

A work tool coupling assembly for a machine with a working implement. The work tool coupling assembly can include an excavator stick and a pin grabber coupler. The pin grabber coupler can include a first plate, a second plate, and a middle plate positioned between the first plate and second plate. The middle plate includes a portion protruding away from the first plate and second plate and is coupled to the excavator stick by a stick pin. The middle plate, the first plate, and the second plate are configured to couple with the working implement.

18 Claims, 5 Drawing Sheets

WORK TOOL COUPLING ASSEMBLY WITH LOCKING WEDGE

TECHNICAL FIELD

The present disclosure generally pertains to machines. More particularly this disclosure is directed toward a work tool coupling assembly for a machine.

BACKGROUND

Excavators, backhoes, and other machines commonly have a movable linkage for controlling motion of an implement, such as a bucket, blade, hammer, grapple, fork arrangement, etc. A coupler may be used to increase the functionality and versatility of a machine by allowing different implements to be interchangeably connected to a stick or arm of the machine.

U.S. Pat. No. 6,241,455 to Schupback et. al. describes an earth-moving machine that includes a coupling releasably joining a bucket to an end of a dipper stick. The coupling includes a hook pivotably coupled to the dipper stick about a first axis and configured to engage a pin secured to the bucket. The coupling further includes a pair of pins coaxially disposed along the axis and movable between an extended position in which the pins are received within a pair of spaced openings on the bucket to join the bucket to the dipper stick and a retracted position in which the pins are removed from the openings. The pins are actuated between the extended position and the retracted position by an actuator disposed along the axis between the pins. The actuator preferably includes a cylinder, first and second pistons disposed within the cylinder and coupled to the first and second pins, respectively, and at least one source of hydraulic pressure fluidly coupled to the cylinder to pressurize the cylinder and to move the first and second pistons and the first and second pins. The cylinder is preferably disposed within a bushing coupled to the dipper stick.

The present disclosure is directed toward improvements in the art.

SUMMARY

A work tool coupling assembly for a machine is disclosed herein. The work tool coupling assembly includes an excavator stick and a pin grabber coupler. The excavator stick includes a stick body and a first stick leg extending from the stick body. The first stick leg includes a first leg bore distal to the stick body. The excavator stick further includes a second stick leg extending from the stick body substantially parallel with the first stick leg. The second stick leg is spaced from the first stick leg. The second stick leg includes a second leg bore distal to the stick body. The second stick leg bore is aligned with the first leg bore.

The pin grabber coupler includes a first plate, a second plate, and a middle plate. The first plate includes a first plate front end and a first plate back end located opposite the first plate front end. The first plate further includes a first plate linkage bore and a first plate bottom bucket receiver located adjacent to the first plate front end. The first plate further includes a first plate top bucket receiver located adjacent to the first plate back end. The second plate includes a second plate front end and a second plate back end located opposite the second plate front end. The second plate further includes a second plate linkage bore aligned with the first plate linkage bore. The second plate further includes a second plate bottom bucket receiver located adjacent to the second plate front end. The second plate bottom bucket receiver is aligned with the first plate bottom bucket receiver. The second plate further includes a second plate top bucket receiver located adjacent to the second plate back end. The second plate top bucket receiver is aligned with the first plate top bucket receiver. The middle plate is positioned between and affixed to the first plate and the second plate. The middle plate includes a middle plate front portion protruding beyond the first plate and the second plate and away from the first plate top bucket receiver and the second plate top bucket receiver. the middle plate front portion includes a middle plate front end distal to the first plate back end and the second plate back end. The middle plate front portion further includes a middle plate stick bore extending therethrough. The middle plate stick bore is located proximate to the middle plate front end. The middle plate further includes a middle plate bottom bucket receiver located proximate to the first plate front end and the second plate front end. The middle plate bottom bucket receiver is aligned with the first plate bottom bucket receiver and the second plate bottom bucket receiver.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Furthermore, some of the features and surfaces have been left out or exaggerated for clarity and ease of explanation.

Figure 1:
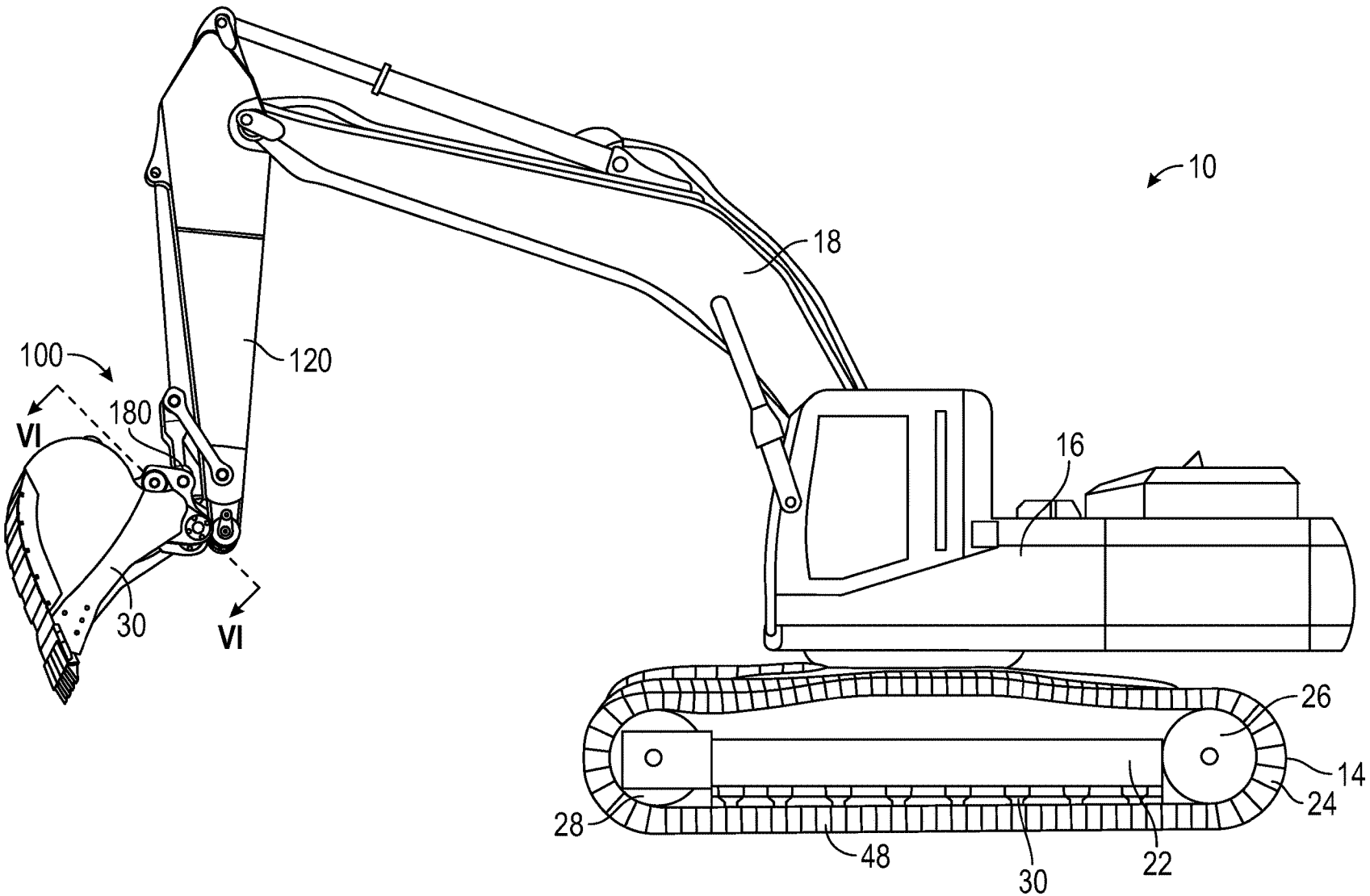
FIG. 1 is an illustration of a an exemplary track vehicle with a work tool assembly.

FIG. 1 is an illustration of a track vehicle with a rotating assembly. Where the drawing includes multiple instances of the same feature, for example rollers 30, the reference number is only shown in connection with one instance of the feature to improve the clarity and readability of the drawing. This is also true in other drawings which include multiple instances of the same feature.

A machine 10 (sometimes referred to as a track vehicle or track machine) may include a pair of track assemblies 14, only one of which is shown in FIG. 1. Machine 10 may be any type of machine that includes an undercarriage with one or more track assemblies 14. In the embodiment shown, machine 10 is an excavator having a superstructure 16 pivotally supported from the undercarriage. In this embodiment, machine 10 may include a boom 18 and a work tool coupling assembly 100 attached to it. The work tool coupling assembly 100 may have a working implement 20 (also referred to as a bucket) also attached to it, coupling the bucket 20 to the boom 18. The work tool coupling assembly 100 can include an excavator stick 120 and a pin grabber coupler 180.

Each track assembly 14 may be configured to support machine 10 from and move along the ground, roads, and/or other types of terrain. Each track assembly 14 may include a track roller frame 22, various guide components engaged to track roller frame 22, a drive sprocket 26, an idler 28, rollers 30, and an endless track 24 extending around drive sprocket 26, the idler 28, and rollers 30.

Figure 2:
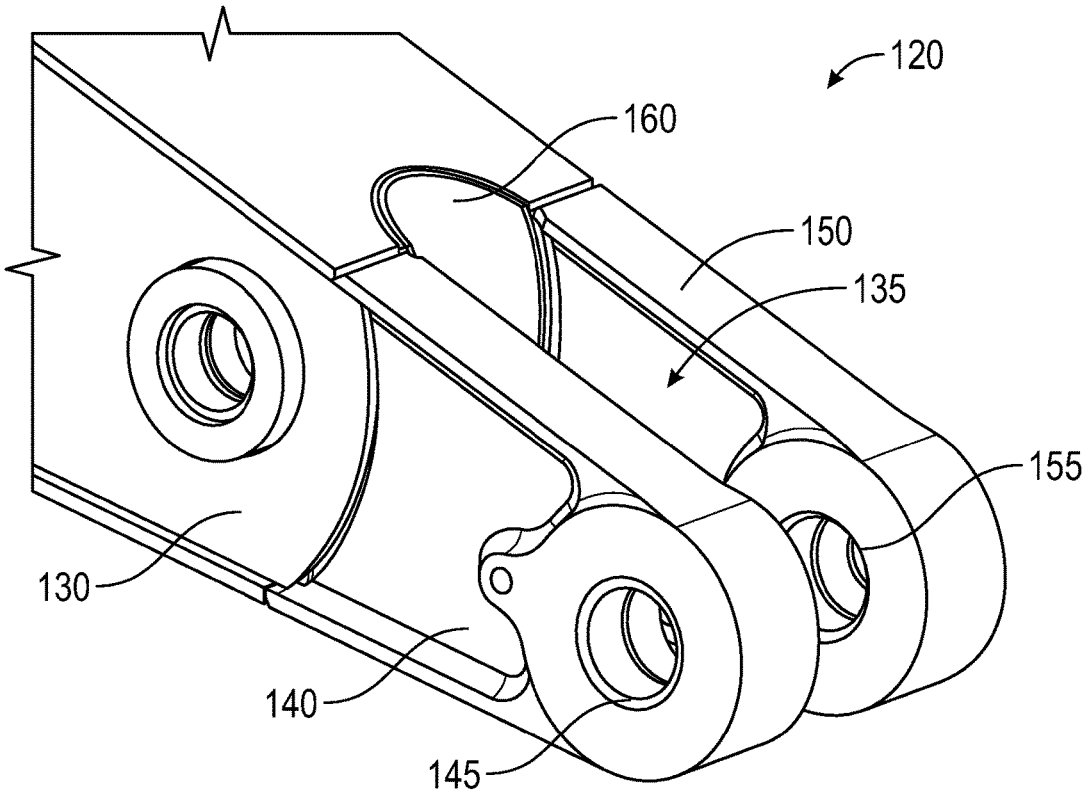
FIG. 2 is a perspective view of the excavator stick from FIG. 1.

FIG. 2 is a perspective view of the excavator stick from FIG. 1. The excavator stick 120 can include a stick body 130, a first stick leg 140, and a second stick leg 150. The first stick leg 140 can extend from the stick body 130. The first stick leg 140 can have a first leg bore 145 distal to the stick body 130. The second stick leg 150 can extend from the stick body 130 substantially parallel with the first stick leg 140. The second stick leg 150 is spaced from the first stick leg 140. The second stick leg 150 having a second leg bore 155 distal to the stick body 130. The second stick leg bore 155 can be aligned with the first leg bore 145. The first stick leg 140, the second stick leg 150, and the stick body 130 can define a stick gap 135.

The excavator stick 120 can include a concave portion 160 located adjacent to the interface of the stick body 130, the first stick leg 140, and the second stick leg 150.

Figure 3:
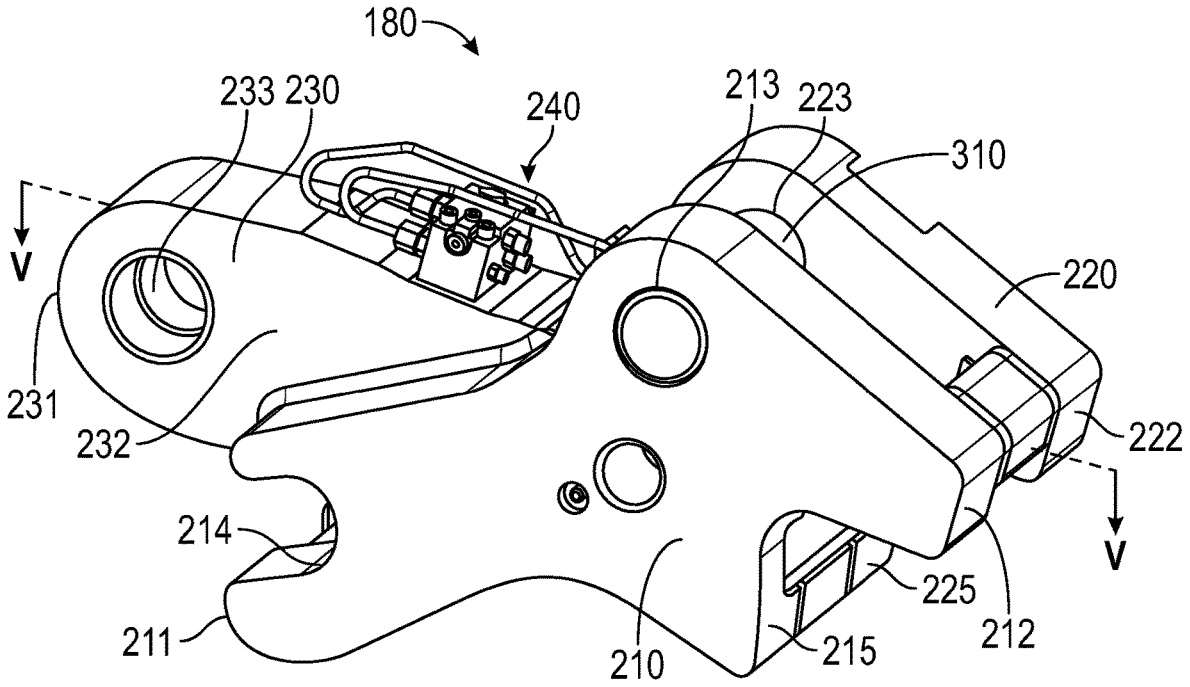
FIG. 3 is a perspective view of the pin grabber coupler from FIG. 1.

FIG. 3 is a perspective view of the pin grabber coupler from FIG. 1. The pin grabber coupler 180 can include a first plate 210, a second plate 220, and a middle plate 230 which comprise the body of the pin grabber coupler. The first plate 210 can include a first plate front end 211 and a first plate back end 212 located opposite the first plate front end 211. The first plate 210 can include a first plate linkage bore 213 and a first plate bottom bucket receiver 214 located adjacent the first plate front end 211. The first plate bottom bucket receiver 214 can form at least one of a C-shape and a U shape. The first plate 210 can include a first plate top bucket receiver 215 located adjacent the first plate back end 212. The first plate top bucket receiver 215 can form an L shape.

The second plate 220 can include a second plate back end 222. The second plate 220 can include a second plate linkage bore 223 aligned with the first plate linkage bore 213. The second plate 220 can include a second plate top bucket receiver 225 located adjacent to the second plate back end 222. The second plate top bucket receiver 225 can be aligned with the first plate top bucket receiver 215 collectively the top bucket receiver of the pin grabber coupler. The second plate top bucket receiver 225 can form an L shape.

The middle plate 230 can be positioned between the first plate 210 and the second plate 220 and affixed to the first plate 210 and the second plate 220. The middle plate 230 can include a middle plate front portion 232 which protrudes beyond the first plate 210 and the second plate 220 and away from the first plate top bucket receiver 215 and the second plate top bucket receiver 225. The middle plate front portion 232 can include a middle plate front end 231 distal to the first plate back end 212 and the second plate back end 222. The middle plate front portion 232 can include a middle plate stick bore 233 extending therethrough. The middle plate stick bore 233 can be located proximate to the middle plate front end 231.

The pin grabber coupler 180 can include a linkage pin 310 extending through the first plate linkage bore 213 and the second plate linkage bore 223.

The pin grabber coupler 180 can include an external portion 240 of a locking assembly. The external portion 240 of the locking assembly can be affixed along a top edge of the middle plate 230 and approximately positioned between the middle plate stick bore 233, the first plate linkage bore 213 and the second plate linkage bore 223.

Figure 4:
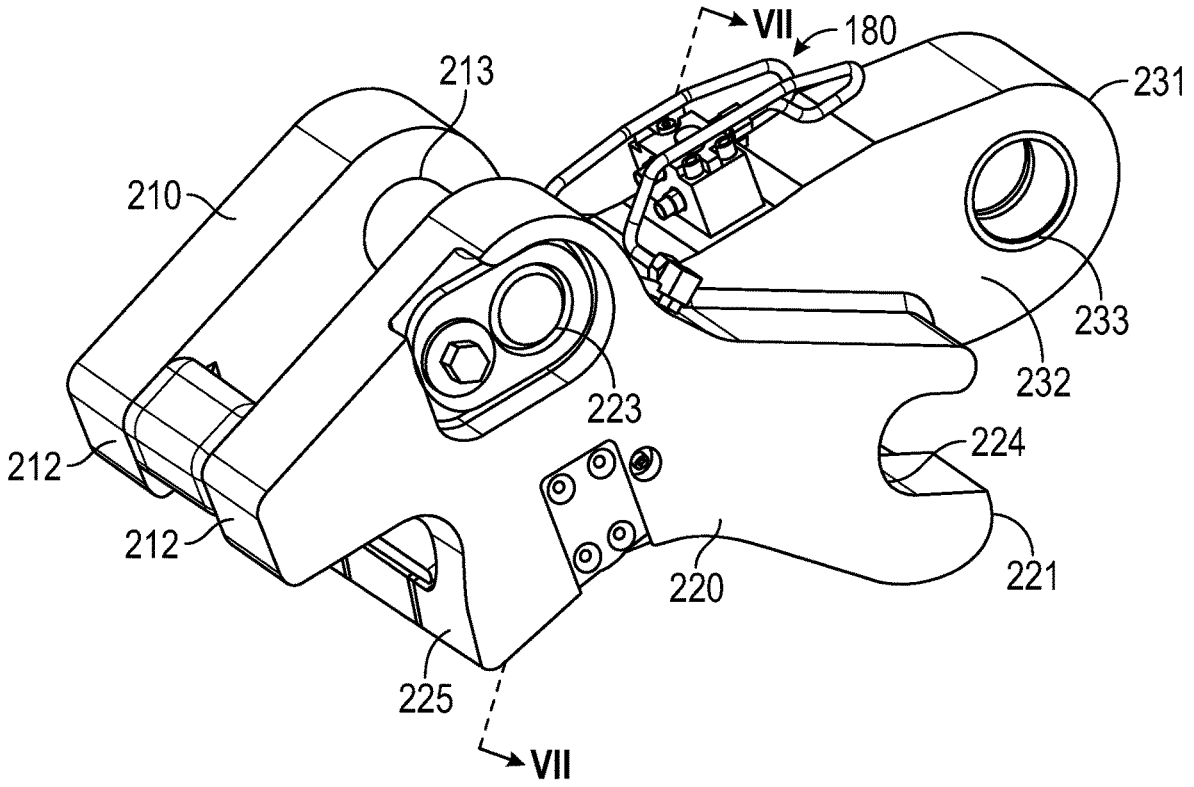
FIG. 4 is a perspective view from another side of the pin grabber coupler from FIG. 1.

FIG. 4 is a perspective view from another side of the pin grabber coupler from FIG. 1. The second plate 220 can include a second plate front end 221, opposite from the second plate back end 222. The second plate 220 can include a second plate bottom bucket receiver 224 located adjacent to the second plate front end 221. The second plate bottom bucket receiver 224 is aligned with the first plate bottom bucket receiver 214. The second plate bottom bucket receiver 224 can form at least one of a C-shape and a U shape.

Figure 5:
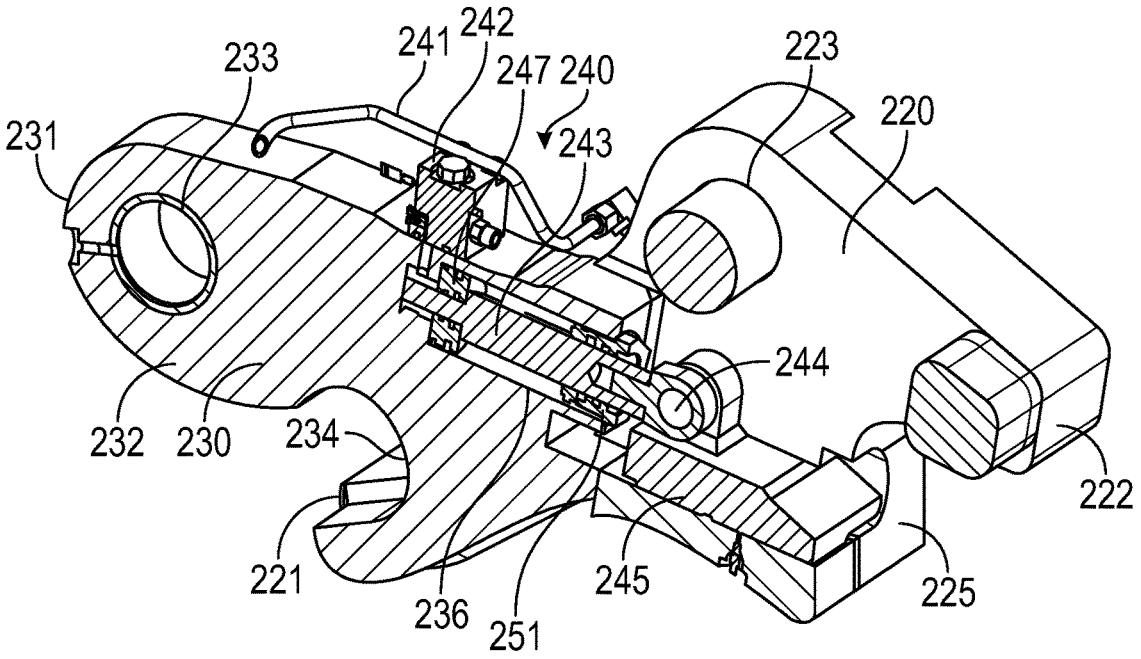
FIG. 5 is a cross-section view of the pin grabber coupler from FIG. 1 taken along plane V-V shown in FIG. 3, with the first plate and a portion of the middle plate removed.

FIG. 5 is a cross-section view of the pin grabber coupler from FIG. 1, with the first plate and a portion of the middle plate removed. The middle plate 230 can include a middle plate bottom bucket receiver 234 located proximate to the first plate front end 211 (shown on FIG. 3) and the second plate front end 221 (shown on FIG. 4). The middle plate bottom bucket receiver 234 can be aligned with the first plate bottom bucket receiver 214 (shown on FIG. 3) and the second plate bottom bucket receiver 224 (shown on FIG. 4) collectively forming the bottom bucket receiver of the pin grabber coupler. The middle plate bottom bucket receiver 234 can form at least one of a C shape and a U shape.

The middle plate 230 can include a locking assembly cylinder or bore 236, for example, machined into the middle plate 230. The locking assembly bore 236 can extend from between the first plate 210 (shown in FIG. 3) and the second plate 220 and into the middle plate front portion 232. The locking assembly bore 236 can be located opposite from the middle plate front end 231. In an embodiment the locking assembly bore 236 can be cylindrically shaped. In other examples the locking assembly bore 236 has a cubic shape or other shapes.

The external portion 240 of the locking assembly can include hydraulic tubes 241 and hydraulic valves 242. The locking assembly includes the external portion 240, a cylinder rod 243, a cylinder head 251 and a locking wedge 245. In an embodiment the hydraulic valves 242 can be positioned along the upper perimeter of the middle plate front portion 232. The hydraulic valves 242 can be in fluid communication with one or more of the hydraulic tubes 241. The cylinder rod 243 can be positioned within the locking assembly bore 236 and can include a piston 247. The locking assembly bore 236 can be in fluid communication with the hydraulic valves 242 which are arranged to selectively deliver hydraulic force to either side of the piston 247. A cylinder head 251 is located at the open end of the locking assembly bore 236. In an embodiment, the cylinder head 251 is threaded into the locking assembly bore 236 and includes one or more seals about the cylinder rod 243.

The locking wedge 245 can be positioned between the first plate 210 and the second plate 220. The locking wedge 245 can extend from proximate the cylinder rod 243 towards the first plate top bucket receiver 215 and the second plate top bucket receiver 225. The locking wedge 245 can be operable to extend into the first plate top bucket receiver 215 (shown on FIG. 3) and the second plate top bucket receiver 225. The cylinder rod 243 can be coupled to the locking wedge 245. In an embodiment the cylinder rod 243 is coupled to the locking wedge 245 via locking pin 244. The locking wedge 245 can be wedge shaped at the end opposite the locking pin 244. The locking wedge can extend from proximate the cylinder rod 243 to proximate the first plate top bucket receiver 215 and the second plate top bucket receiver 225. The locking wedge 245 can have a wedge like shape located proximate to the first plate top bucket receiver 215 and the second plate top bucket receiver 225.

A portion of the locking assembly 240 can be positioned between the first plate 210 (shown on FIG. 3) and the second plate 220.

Figure 6:
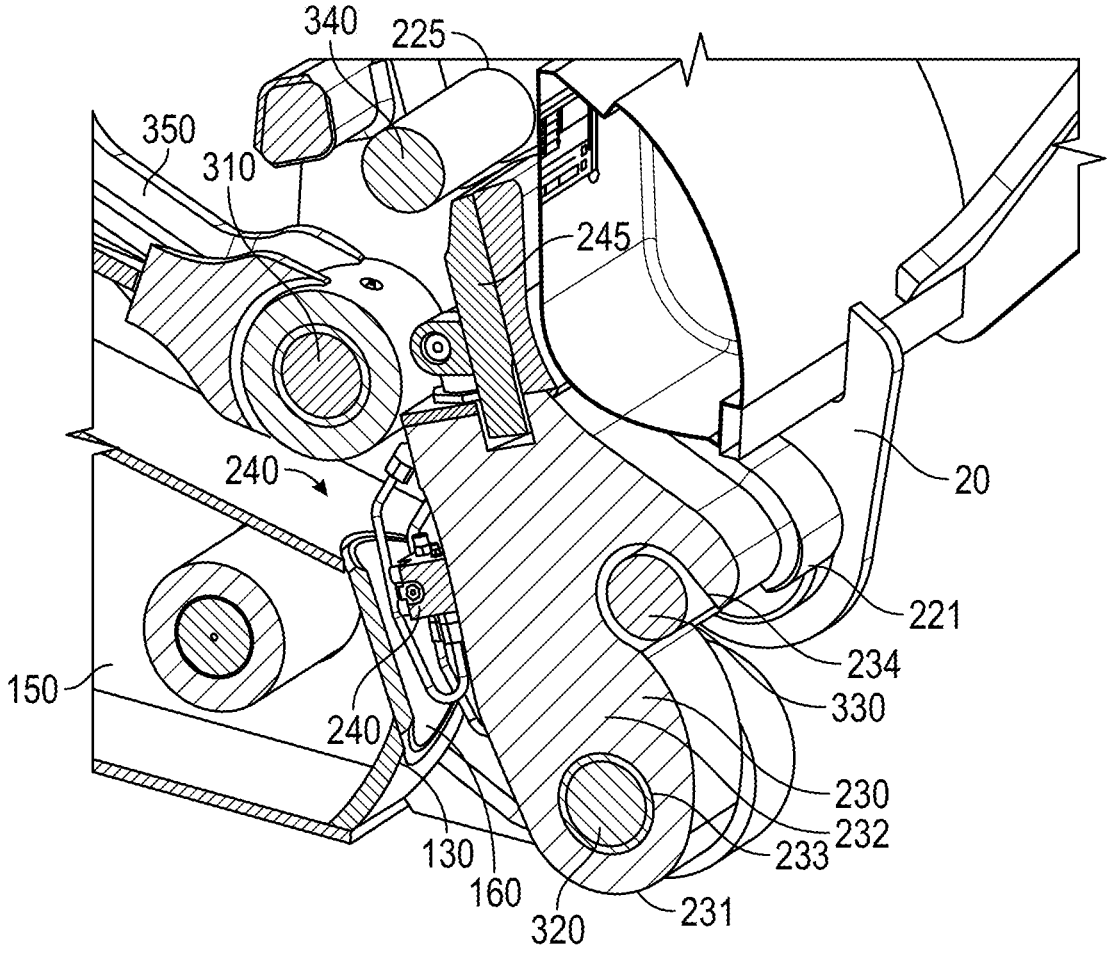
FIG. 6 is a perspective cross section view of the work tool coupler assembly and bucket from FIG. 1 taken along plane VI-VI shown in FIG. 1, with the first stick leg, the first plate, and a portion of the bucket removed.

FIG. 6 is a perspective view of the work tool coupler assembly and bucket from FIG. 1, with the first stick leg, the first plate, and a portion of the bucket removed. The pin grabber coupler 180 can be coupled to the excavator stick 120 via a stick pin 320 extending through the first leg bore 145 (shown on FIG. 2), through the middle plate stick bore 233, and through the second leg bore 155. In other words, the middle plate stick bore 233 aligns with the first leg bore 145 and the second leg bore 155. In an embodiment, a portion of the middle plate front portion 232 is positioned between the first stick leg 140 and the second stick leg 150. In other words, the middle plate front end 231 is positioned between the first stick leg 140 and the second stick leg 150.

A portion of the locking assembly 240 can be positioned adjacent to the concave portion 160. The concave portion 160 can extend diagonally with respect to the first stick leg 140 and second stick leg 150 to accommodate the external portion 240 of the locking assembly.

The linkage pin 310 can extend through a linkage assembly 350 and through the second plate linkage bore 223 (shown on FIG. 4) to couple the linkage assembly 350 to the second plate 220 and the first plate 210 (shown on FIG. 3).

The bucket 20 can include a bottom bucket pin 330. The bottom bucket pin 330 can extend through the second plate bottom bucket receiver 224 (shown on FIG. 4), the middle plate bottom bucket receiver 234, and the first plate bottom bucket receiver 214 (shown on FIG. 3) to partially couple the bucket 20 to the pin grabber coupler 180.

The bucket 20 can include a top bucket pin 340. The top bucket pin 340 can extend through the second plate top bucket receiver 225, and the first plate top bucket receiver 215 (shown on FIG. 3) to partially couple the bucket 20 to the pin grabber coupler 180.

Figure 7:
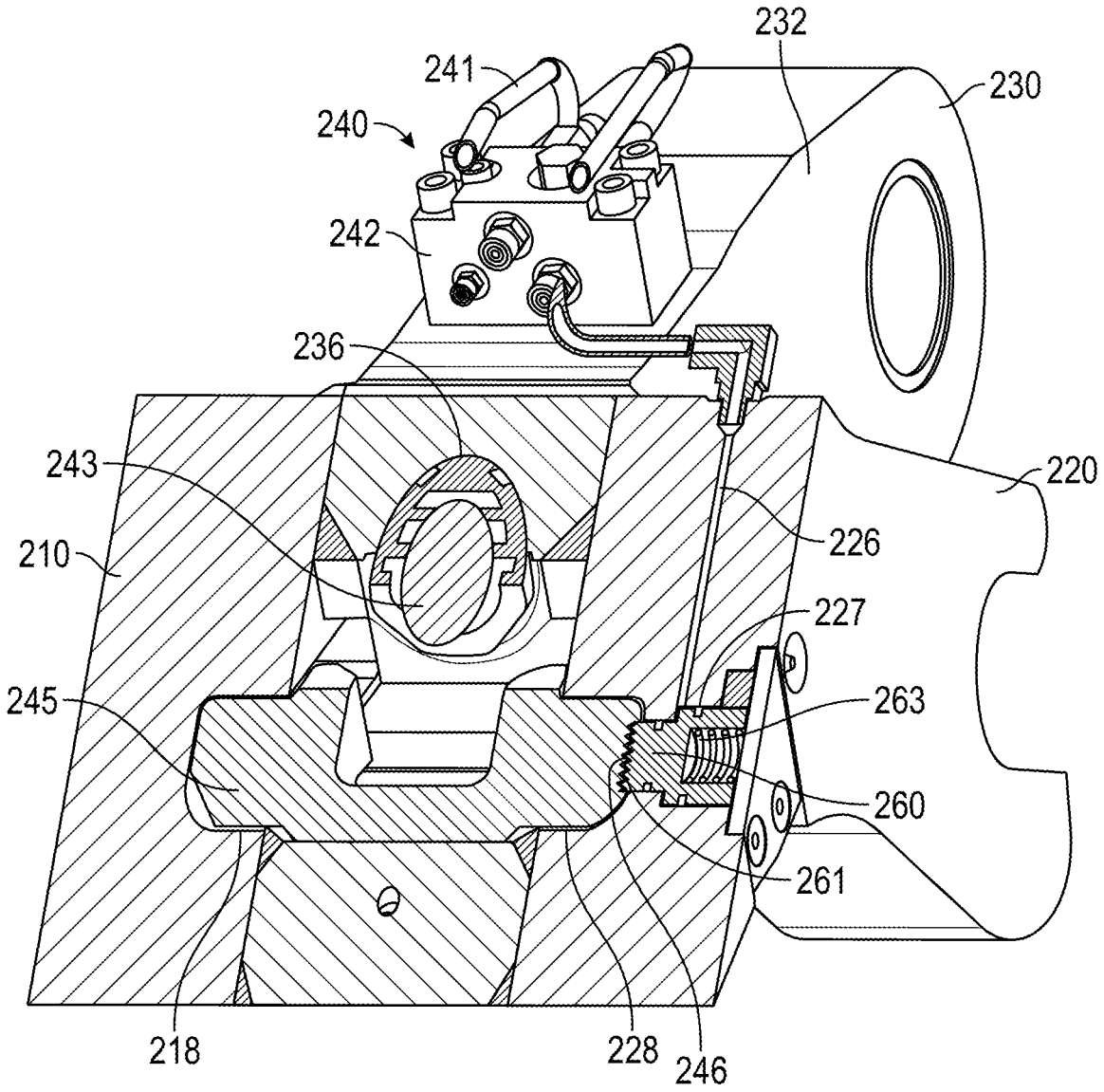
FIG. 7 is a perspective view of the pin grabber coupler from FIG. 1, with a portion of the pin grabber coupler in cross section taken along plane VII-VII shown in FIG. 4 in order to view internal components.

FIG. 7 is a perspective view of the pin grabber coupler from FIG. 1, with a portion of the pin grabber coupler shown in cross section in order to view internal components. The first plate 210 can have a first locking wedge slot 218 and the second plate 220 can have a second locking wedge slot 228, collectively the locking wedge slot. In an embodiment, portions of the locking wedge 245 can be positioned with the first locking wedge slot 218 and the second locking wedge slot 228. The first locking wedge slot 218 and the second locking wedge slot 228 can be shaped to allow the locking wedge 245 to move and slide along the slots 218, 228 into the top bucket receiver. The locking wedge 245 can have locking wedge teeth 246. In an embodiment the locking wedge teeth 246 are located within the second locking wedge slot 228.

The second plate 220 can include a hydraulic channel 226. The hydraulic channel 226 can be in fluid communication with the hydraulic tubes 241 and the hydraulic valves 242. The second plate 220 can include a locking aperture 227 in fluid communication with the hydraulic channel 226. In an embodiment, the hydraulic channel 226 can extend from the hydraulic tubes 241 to a locking aperture 227. The locking aperture 227 can be adjacent to and extending into the second locking wedge slot 228.

The pin grabber coupler 180 can include a locking member 260. The locking member 260 can be positioned within the locking aperture 227 and can extend into the second locking wedge slot 228. The locking member 260 can have locking member teeth 261. In an embodiment the locking member teeth 261 are located on a face opposite to the face on which the locking wedge teeth 246 are located. The locking wedge teeth 246 and the locking member teeth 261 can be shaped to mate with each other. A locking member biasing member such as spring 263 provides a force to cause the locking member 260 to engage with the locking wedge in the absence of hydraulic pressure to overcome the force of the biasing member such as biasing spring 263.

INDUSTRIAL APPLICABILITY

The present disclosure generally applies to a work tool coupling assembly 100 for a machine 10. It is understood that the work tool coupling assembly 100 may be used with any stationary or mobile machine known in the art. Such machines may be used in construction, farming, mining, power generation, and/or other like applications. Accordingly, such machines may include, for example, excavators, track-type tractors, wheel loaders, on-road vehicles, off-road vehicles, generator sets, motor graders, or other like machines.

In use, the excavator stick 120 and pin grabber coupler 180 may allow different implements to be interchangeably connected to a machine 10. The pin grabber coupler 180 can have reduced coupler offset and provide a reduced tip radius, which can provide a reduction in the force required to rotate working implements such as the bucket 20. In an embodiment, the configuration of the pin grabber coupler 180 can reduce tip radius by approximately 6% and a reduction in force required by approximately 16%.

During operation of the machine 10, the linkage assembly 350 can be actuated to pivotally rotate the pin grabber coupler 180 about the stick pin 320. The excavator stick 120 can include a stick gap 135 and a concave portion 160 that are sized to provide clearance for the middle plate 230 and a portion of the external portion 240 of the locking assembly.

The working implement 20 can be picked up and coupled to the pin grabber coupler 180 by utilizing the locking assembly. Hydraulic fluid can be transported via the hydraulic tubes 241 to the hydraulic valves 242. From the hydraulic valves 242, the hydraulic fluid can be transported into the locking bore 236, behind the piston 247, away from pin 244, to actuate the cylinder rod 243 to extend further out of the locking bore 236. As the cylinder rod 243 is actuated, the locking wedge 245 is actuated forward. If the top bucket pin 340 is positioned within the first plate top bucket receiver 215 and the second plate top bucket receiver 225, then the forward movement of the locking wedge 245 locks in the working implement 20 to the pin grabber coupler 180. In other words, the forward position of the locking wedge 245 prevents unintended disengagement of the working implement 20 from the pin grabber coupler 180. The locking wedge 245 can be moved to its original position by applying the hydraulic pressure/hydraulic fluid on the opposite side (in front) of the piston 247 to drive it back into the locking bore 236.

In an embodiment, the hydraulic valves 242 include a pilot operated check valve. When the locking wedge 245 is extended, in the event of the loss of hydraulic fluid pressure, the pilot operated check valve closes which locks the hydraulic fluid in the locking assembly bore 236 which keeps the locking wedge 245 in its extended position.

Hydraulic fluid can also be transported from the hydraulic valves 242 to the hydraulic channel 226 and subsequently to the locking aperture 227. The presence of hydraulic fluid/pressure within the locking aperture 227 can move the locking member 260 away from the locking wedge 245, overcoming the force of the biasing spring 263, disengaging the locking member teeth 261 from the locking wedge teeth 246. Without hydraulic pressure, the locking member teeth 261 can engage and mate with the locking wedge teeth 246 because of the force from the biasing spring 263. In an event that hydraulic pressure is lost inadvertently, the locking member 260 can be positioned to prevent the locking wedge 245 from disengaging with the top bucket pin 340.

Although this disclosure has been shown and described with respect to detailed embodiments thereof, it will be understood by those skilled in the art that various changes in form and detail thereof may be made without departing from the spirit and scope of the claimed disclosure. Accordingly, the preceding detailed description is merely exemplary in nature and is not intended to limit the disclosure of the application and uses of the disclosure.

What is claimed is:

1. A pin grabber coupler for coupling a work tool to a machine, the pin grabber coupler comprising:
- a bottom bucket receiver located adjacent to a front end of the pin grabber coupler;
- a top bucket receiver located adjacent to a back end of the pin grabber coupler;
- a front portion protruding beyond and away from the top bucket receiver and having a stick bore extending there through;
- a locking assembly bore formed in the pin grabber coupler and having an open end;
- a cylinder rod in the locking assembly bore and having a piston;
- a cylinder head threaded into the locking assembly bore at the open end of the locking assembly bore; and
- a locking wedge coupled to the cylinder rod, the locking wedge located adjacent to the top bucket receiver and capable of extending into the top bucket receiver.

2. The pin grabber coupler of claim 1, further comprising hydraulic valves located external to the pin grabber coupler on an outer surface opposite the bottom bucket receiver, in fluid communication with the locking assembly bore and which are arranged to selectively deliver hydraulic force to either side of the piston.

3. The pin grabber coupler of claim 1 further comprising a locking wedge slot formed in the pin grabber coupler adjacent to and opening into the top bucket receiver, wherein the locking wedge is at least partially located in the locking wedge slot.

4. The pin grabber coupler of claim 3, further comprising a locking aperture adjacent to and extending into the locking wedge slot; a locking member located at least partially within the locking aperture; and a biasing member which provides a biasing force to the locking member in the direction of the locking wedge slot.

5. A pin grabber coupler for a machine with an excavator stick, the pin grabber coupler comprising:
- a bottom bucket receiver located adjacent to a front end of the pin grabber coupler;
- a top bucket receiver located adjacent to a back end of the pin grabber coupler;
- a front portion protruding beyond and away from the top bucket receiver and having a stick bore extending there through;
- a locking assembly bore formed in the pin grabber coupler;
- a cylinder rod in the locking assembly bore and having a piston;
- a locking wedge coupled to the cylinder rod, the locking wedge located adjacent to the top bucket receiver;
- a locking wedge slot formed in the pin grabber coupler adjacent to and opening into the top bucket receiver, wherein the locking wedge is at least partially located in the locking wedge slot;
- a locking aperture adjacent to and extending into the locking wedge slot;
- a locking member located at least partially within the locking aperture;
- a biasing member in contact with locking member opposite the locking wedge slot;
- wherein the locking member further includes locking teeth on a face opposite the locking aperture and towards the locking wedge and the locking wedge further includes locking teeth on a face opposite the locking teeth of the locking member.

6. The pin grabber coupler of claim 5, wherein the locking wedge is wedge shaped at an end distal to where the locking wedge is coupled to the cylinder rod.

7. The pin grabber coupler of claim 5, further including hydraulic valves located external to the pin grabber coupler on an outer surface opposite the bottom bucket receiver, in fluid communication with the locking assembly bore and which are arranged to selectively deliver hydraulic force to either side of the piston.

8. The pin grabber coupler of claim 7, further including a hydraulic channel in fluid communication with the locking aperture to provide hydraulic force sufficient to overcome the force of the biasing member.

9. The pin grabber coupler of claim 8, wherein the locking wedge includes locking wedge teeth and wherein the locking member further includes locking member teeth positioned adjacent to the locking wedge teeth and shaped to mate with the locking member teeth.

10. A work tool coupling assembly comprising:
- an excavator stick; and
- a pin grabber coupler coupled to the excavator stick, the pin grabber coupler including
  - a bottom bucket receiver located adjacent to a front end of the pin grabber coupler;
  - a top bucket receiver located adjacent to a back end of the pin grabber coupler;
  - a front portion protruding beyond and away from the top bucket receiver and having a stick bore extending there through; and
  - a locking assembly including
    - a locking assembly bore formed in the pin grabber coupler and having an open end,
    - a cylinder rod in the locking assembly bore and having a piston, a cylinder head threaded into the open end of the locking assembly bore, and a locking wedge coupled to the cylinder rod, the locking wedge located adjacent to the top bucket receiver and configured to extend into the top bucket receiver.

11. The work tool coupling assembly of claim 10, further comprising a bucket coupled to the pin grabber coupler via the bottom bucket receiver and the top bucket receiver.

12. The work tool coupling assembly of claim 10, wherein the bottom bucket receiver comprises a first plate bottom bucket receiver, a second plate bottom bucket receiver, and a middle plate bottom bucket receiver which together form at least one of a C shape and a U shape.

13. The work tool coupling assembly of claim 10, further comprising an external portion of the locking assembly external to the pin grabber coupler on an outer surface opposite the bottom bucket receiver.

14. The work tool coupling assembly of claim 13, wherein the external portion of the locking assembly further includes hydraulic valves in fluid communication with the locking assembly bore and which are arranged to selectively deliver hydraulic force to either side of the piston.

15. The work tool coupling assembly of claim 14, further comprising a cylinder head located at an open end of the locking assembly bore.

16. The work tool coupling assembly of claim 13, wherein the excavator stick includes a stick body, a first stick leg extending from the stick body, the first stick leg having a first leg bore distal to the stick body, a second stick leg extending from the stick body substantially parallel with the first stick leg, the second stick leg spaced from the first stick leg, the second stick leg having a second leg bore distal to the stick body, the second stick leg bore aligned with the first leg bore, and a concave portion to accommodate the external portion of the locking assembly when the pin grabber coupler is in a fully raised position, the concave portion located adjacent to the interface of the stick body, the first stick leg, and the second stick leg.

17. The work tool coupling assembly of claim 16, wherein the front portion of the pin grabber coupler is positioned between the first stick leg and the second stick leg and wherein the stick bore aligns with the first leg bore and the second leg bore.

18. The work tool coupling assembly of claim 17, wherein the top bucket receiver comprises a first plate top bucket receiver and a second plate bottom bucket receiver both of which form an L shape.

* * * * *